US008997861B2

(12) United States Patent
Dumlupinar et al.

(10) Patent No.: US 8,997,861 B2
(45) Date of Patent: Apr. 7, 2015

(54) METHODS AND DEVICES FOR FILLING TANKS WITH NO BACKFLOW FROM THE BOREHOLE EXIT

(75) Inventors: Ates C. Dumlupinar, Houston, TX (US); Quming Zhou, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 436 days.

(21) Appl. No.: 13/414,288

(22) Filed: Mar. 7, 2012

(65) Prior Publication Data

US 2012/0227963 A1 Sep. 13, 2012

Related U.S. Application Data

(60) Provisional application No. 61/450,906, filed on Mar. 9, 2011, provisional application No. 61/452,492, filed on Mar. 14, 2011.

(51) Int. Cl.
*E21B 49/08* (2006.01)
*E21B 49/10* (2006.01)

(52) U.S. Cl.
CPC ..... *E21B 49/08* (2013.01); *E21B 49/10* (2013.01)

(58) Field of Classification Search
CPC ..... E21B 49/10; E21B 49/08; E21B 33/124; G01N 33/26; G01N 33/28
USPC ..... 166/264, 53, 100; 175/59; 73/152.23, 73/152.01, 152.31
See application file for complete search history.

(56) References Cited

U.S. PATENT DOCUMENTS

| | | | | |
|---|---|---|---|---|
| 3,934,468 | A | 1/1976 | Brieger | |
| 4,507,957 | A | 4/1985 | Montgomery et al. | |
| 4,513,612 | A | 4/1985 | Shalek | |
| 4,830,112 | A | 5/1989 | Erickson | |
| 4,860,581 | A | 8/1989 | Zimmerman et al. | |
| 5,230,422 | A | 7/1993 | Karweik et al. | |
| 5,473,939 | A | 12/1995 | Leder et al. | |
| 5,622,223 | A | 4/1997 | Vasquez | |
| 5,644,076 | A | 7/1997 | Proett et al. | |
| 5,708,204 | A | 1/1998 | Kasap | |
| 5,803,186 | A | 9/1998 | Berger et al. | |
| 6,343,507 | B1 | 2/2002 | Felling et al. | |
| 6,467,544 | B1 | 10/2002 | Brown et al. | |
| 6,568,487 | B2 | 5/2003 | Meister et al. | |
| 6,675,892 | B2 | 1/2004 | Kuchuk et al. | |
| 6,719,049 | B2 * | 4/2004 | Sherwood et al. | 166/264 |
| 6,745,835 | B2 | 6/2004 | Fields | |
| 6,763,884 | B2 | 7/2004 | Meister et al. | |
| 6,966,234 | B2 | 11/2005 | Carnegie et al. | |
| 7,011,155 | B2 | 3/2006 | Meister et al. | |

(Continued)

OTHER PUBLICATIONS

PCT/US2012/028280—International Search Report and Written Opinion dated Oct. 23, 2012.

*Primary Examiner* — Yong-Suk (Philip) Ro
(74) *Attorney, Agent, or Firm* — Mossman, Kumar & Tyler, PC

(57) ABSTRACT

A method for sampling fluid from a subsurface formation includes retrieving fluids from the formation using a plurality of pumps. The method also includes the steps of controlling a flow of the retrieved fluids using at least a first valve and a second valve and estimating an operating parameter of at least one pump of the plurality of pumps. The method further includes the step of controlling the first valve and the second valve using the estimated operating parameter to initiate a fluid sampling event.

10 Claims, 2 Drawing Sheets

(56) References Cited

U.S. PATENT DOCUMENTS

| | | | |
|---|---|---|---|
| 7,024,930 | B2 | 4/2006 | Follini et al. |
| 7,025,143 | B2 | 4/2006 | Masak |
| 7,114,385 | B2 | 10/2006 | Fisseler et al. |
| 7,124,819 | B2 | 10/2006 | Ciglenec et al. |
| 7,178,591 | B2 | 2/2007 | Del Campo et al. |
| 7,195,063 | B2 | 3/2007 | Nogueira et al. |
| 7,216,533 | B2 | 5/2007 | McGregor et al. |
| 7,234,521 | B2 | 6/2007 | Shammai et al. |
| 7,246,664 | B2 | 7/2007 | Shammai et al. |
| 7,258,167 | B2 | 8/2007 | Shammai et al. |
| 7,461,547 | B2 | 12/2008 | Terabayashi et al. |
| 7,603,897 | B2 | 10/2009 | Gilbert et al. |
| 7,665,354 | B2 | 2/2010 | Shammai |
| 7,707,878 | B2 | 5/2010 | Kanayama et al. |
| 8,047,286 | B2 | 11/2011 | Zazovsky et al. |
| 2008/0156486 | A1 | 7/2008 | Ciglenec et al. |
| 2011/0100641 | A1* | 5/2011 | Briquet et al. ..... 166/373 |

* cited by examiner

METHODS AND DEVICES FOR FILLING TANKS WITH NO BACKFLOW FROM THE BOREHOLE EXIT

CROSS-REFERENCES TO RELATED APPLICATIONS

This applications claims priority from U.S. Provisional Application Ser. No. 61/450,906, filed Mar. 9, 2011 and from U.S. Provisional Application Ser. No. 61/452,492, filed Mar. 14, 2011, the disclosure of which is incorporated herein by reference in its entirety.

FIELD OF THE DISCLOSURE

This disclosure pertains generally to investigations of underground formations and more particularly to systems and methods for controlling devices for formation testing and fluid sampling within a borehole.

BACKGROUND OF THE DISCLOSURE

Commercial development of hydrocarbon fields requires significant amounts of capital. Before field development begins, operators desire to have as much data as possible in order to evaluate the reservoir for commercial viability. While data acquisition during drilling provides useful information, it is often also desirable to conduct further testing of the hydrocarbon reservoirs in order to obtain additional data. Therefore, after a borehole for a well has been drilled, the hydrocarbon zones are usually tested with tools that acquire fluid samples, e.g., liquids from the formation. These boreholes typically have well fluids at relatively high hydrostatic pressure. Because fluid sampling tools often also have one or more openings that allow fluid communication between the tool interior and the borehole environment (or 'borehole exits'), it is desirable to control flow across these openings to prevent undesirable invasion of a sampling tool by well fluids.

In one aspect, the present disclosure addresses the need to enhance control of borehole exits.

SUMMARY OF THE DISCLOSURE

In aspects, the present disclosure provides methods for sampling fluid from a subsurface formation. The method may include retrieving fluids from the formation using a plurality of pumps; controlling a flow of the retrieved fluids using at least a first valve and a second valve; estimating an operating parameter of at least one pump of the plurality of pumps; and controlling the first valve and the second valve using the estimated operating parameter to initiate a fluid sampling event.

In aspects, the present disclosure includes an apparatus for sampling fluid from a subsurface formation. The apparatus may include a plurality of pumps configured to retrieve fluids from the formation; at least a first valve and a second valve configured to control a flow of the retrieved fluids; and a controller configured to control the first valve and the second valve using an estimated operating parameter of at least one pump of the plurality of pumps to initiate a fluid sampling event.

Examples of certain features of the disclosure have been summarized rather broadly in order that the detailed description thereof that follows may be better understood and in order that the contributions they represent to the art may be appreciated.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION

In aspects, the present disclosure relates to devices and methods for providing enhanced control of flow control devices used to retrieve fluids. In particular, embodiments of the present disclosure minimize, if not eliminate, backflow through borehole exits. Illustrative control schemes according to this disclosure employ timing techniques that coordinate valve actuation with pump operation to ensure that sample retrieval occurs at desired times and/or at specified conditions. The teachings may be advantageously applied to a variety of systems in the oil and gas industry, water wells, geothermal wells, surface applications and elsewhere. Merely for clarity, certain non-limiting embodiments will be discussed in the context of tools configured for wellbore uses.

Figure 1:
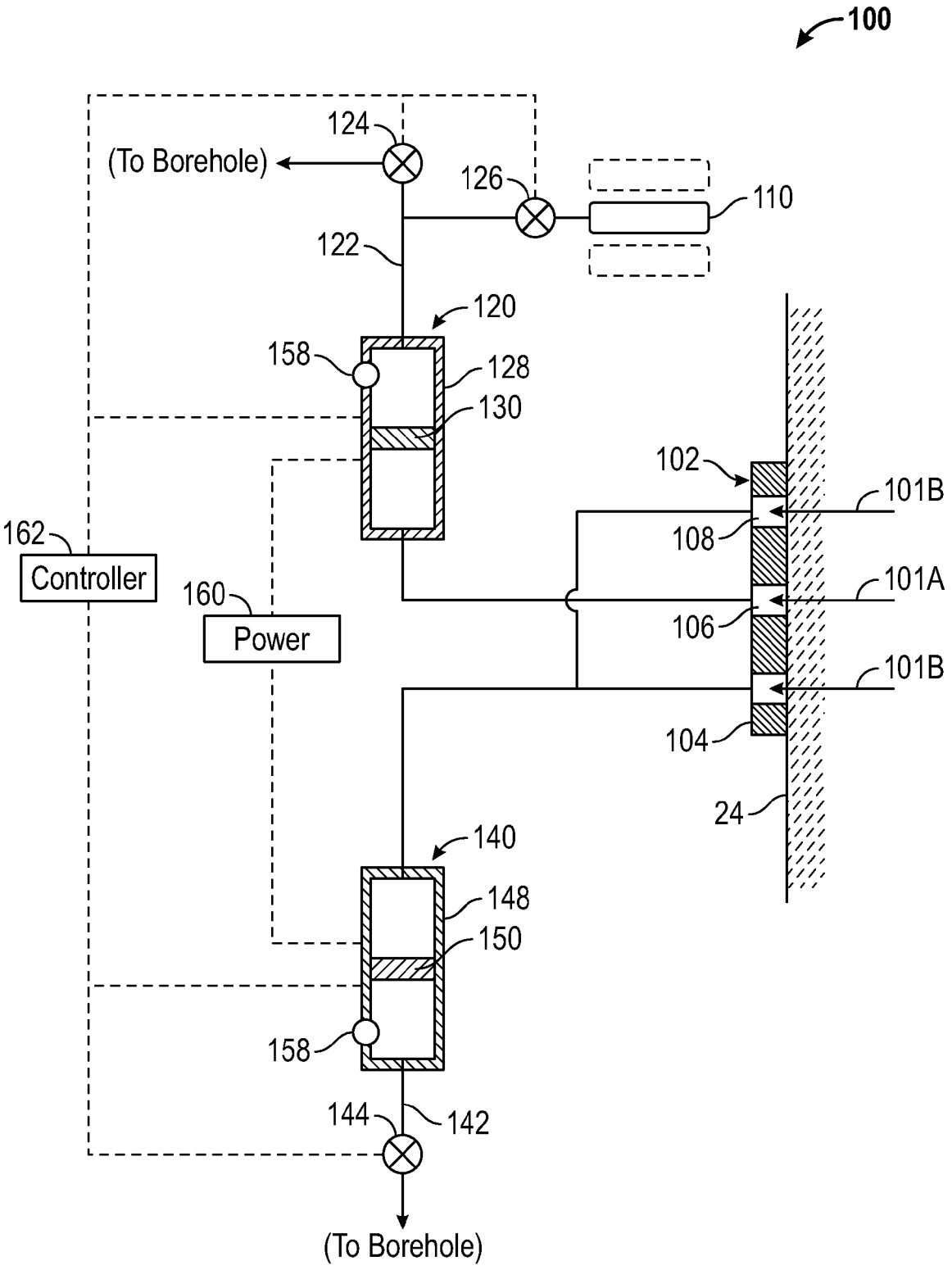
FIG. 1 shows a schematic of a control apparatus for a fluid sampling tool according to one embodiment of the present disclosure.

Referring initially to FIG. 1, there is schematically illustrated one embodiment of a fluid retrieval tool 100 that may be used to retrieve fluids from a desired location e.g., a hydrocarbon bearing reservoir. The tool 100 may include a sampling probe 102 that has a pad 104 in which is formed a sampling passage 106 and a perimeter passage 108. The sampling probe 102 may be a concentric pad type wherein the passage 106 is encircled by the perimeter passage 108. Thus, formation fluid is drawn from two separate and distinct regions 101A, 101B, on a borehole wall 24. In one embodiment, fluid retrieved via the sampling passage 106 may be conveyed to and stored in one or more sampling tanks 110. Fluid retrieved via the perimeter passage 108 may be conveyed to a location outside of the tool 100. For convenience, the area outside of the tool 100 will be referred to as the "borehole." It should be understood that this area includes the annular space between the tool 100 and a borehole wall 24. Fluid retrieval may be performed by pump systems discussed in greater detail below.

In one arrangement, using vacuum pressure, a sample pump 120 draws fluid from the sampling passage 106 and a perimeter pump 140 draws fluid from the perimeter passage 108. The sample pump 120 pumps the fluid via a line 122 to either the borehole or the tank 110. For example, the line 122 may be in fluid communication with a borehole valve 124 that provides fluid communication with the borehole and a valve 126 that provides communication with the sampling tank 110. Likewise, the perimeter pump 140 conveys or pumps the fluid via a line 142 to a borehole valve 144 that provides fluid communication with a borehole. The valves 124, 126, 144 may be actuated between an open position and a closed position using actuators (not shown) that are responsive to control signals. The valves 124, 126, 144 may be bi-directional valves that allow fluid flow in both directions. Valves 124, 144 are borehole exits because they control fluid communication with the borehole. The pumps 120, 140 may be energized by the same power source 160 or independent power sources. The power source 160 may be electric, hydraulic, pneumatic, etc.

In embodiments, the pumps 120, 140 may be a single-action or dual action piston pumps. For example, the pump 120 may include a cylinder 128 in which a piston 130 reciprocates. Similarly, the pump 140 may include a cylinder 148 in which a piston 150 reciprocates. During the piston stroke, i.e., as the pistons 130, 150 travel from one end of the cylinders 128, 148 to the other, respectively, pressurized fluid is ejected into the lines 122, 142, respectively. It should be noted that at the end of a piston stroke, fluid pressure may drop in the line 122 due to the cessation of piston movement. If both valves 124, 126 are open and if the pressure in the line 122 is less than borehole pressure, then borehole fluids may enter via the borehole valve 124 and invade the sample tank 110 via the sample valve 126. This condition is sometimes referred to as "backflow."

To minimize or eliminate backflow, embodiments of the present disclosure control one or more aspects of the operation of tool 100 to ensure that sample retrieval activity is initiated only when the pressure in the line 122 is greater than the pressure in the borehole.

Figure 2:
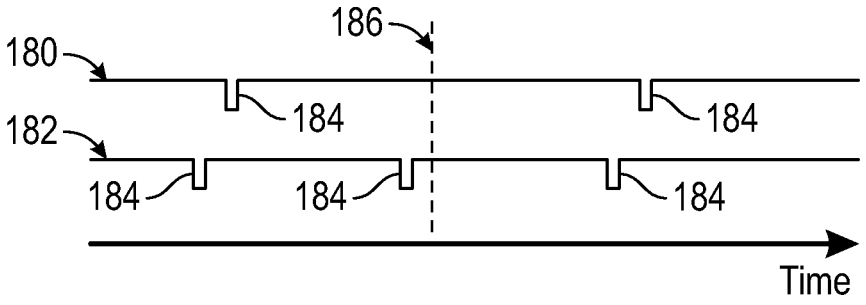
FIG. 2 shows illustrative stroke rates for pumps used in fluid sampling tools according to the present disclosure.

An illustrative method to prevent backflow involves timing the closing of the valve 124 and the opening of the valve 126 with the operation of the pumps 120, 140. Referring to FIG. 2, there is shown a line 180 illustrating the stroke rate of the pump 120 (FIG. 1) and a line 182 showing the stroke rate of the pump 140 (FIG. 1). The stroke rates of the pumps 120, 140 may be different; e.g., the stroke rate of the pump 140 may be about three times greater than the stroke rate of the pump 120. A transient state of the pistons 130, 150 is shown with numeral 184. The transient state 184 may be when the pistons 130, 150 are decelerating, accelerating, or stationary. All of these states indicate of an end or beginning of a piston stroke. The time between transients states 184 will be referred to as stroke period or stroke duration. The maximum pressure in the line 122 (FIG. 1) may occur during the stroke period of either or both pumps 120, 140. The pressure may drop when one, or more likely both, of the pumps 120, 140 are at the transient state 184. Therefore, the positions (i.e., opening and closing) of the valves 124, 126 are changed during the stroke period to give sufficient time for the valves 124, 126 to fully close and open, respectively.

In some arrangements, the stroke period may be minutes whereas the time to change positions of the valves 124, 126 may be seconds. As shown, the valves 124, 126 may be actuated on or after the relatively faster pump 140 initiates a stroke. This point in time is shown with numeral 186. By coordinating the change in valve positions with the pump strokes of the pumps 120, 140, the pressure in the line 122 may be maintained at a value higher than the pressure in the borehole (or 'positive pressure differential'). Thus, backflow may be minimized, if not eliminated.

In some arrangements, the sampling event may be human initiated. For example, sensors may transmit signals representative of one or more selected operating parameters to the surface. Illustrative operating parameters may include aspects of a piston stroke, such as position, duration, direction, speed, etc. Based on these measurements, a human operator may initiate a sampling event while a positive pressure differential between the line 122 and the borehole is present.

In other arrangements, a controller 162 may be used to control the operation of tool 100 to ensure that sample retrieval occurs at desired times and/or at specified conditions. For example, the controller 162 may estimate one or more operating parameters of the pumps 120, 140 and use the estimated control parameter(s) to control the valves 124, 126 and/or the pumps 120, 140.

In arrangements where the pumps 120, 140 may have different stroke times (i.e., stroke duration), a sensor 158 may be used to directly or indirectly estimate the positions of the pistons 130, 150. Illustrative direct measurements may be made by a position sensor that estimates the piston position using physical contact, magnetic signals, acoustic signals, electrical signals, etc. Illustrative indirect measurements may be made by a pressure sensor that detects changes in pressure or flow sensors that detect a change in flow rate. Other indirect measurement may include parameters associated with the motor or power source driving the pumps 120, 140 (e.g., torque, current, voltage). The changes or the rate of changes may be indicative of an end of a piston stroke. While the sensor 158 is shown adjacent to the pumps 120, 140, it should be understood that the sensors may be positioned wherever needed to acquire information regarding a given operating parameter; e.g., at the power source 160, in the lines 122, 142, etc.

In an illustrative control scheme, the controller 162 may first monitor sensor signals to identify when the slower pump 120 has reached the end of the stroke. Next, the controller 162 monitors sensor signals to identify when the faster pump 140 has reached the end of the stroke. At or immediately after that time, the controller 162 opens the sample valve 126 and closes the borehole valve 124 to initiate the sampling event. Because both pumps 120, 140 are at or near the initial period of their stroke, it is improbable, if not impossible, for either pump 120, 140 to stop pumping while both the borehole valve 124 and the sample valve 126 are open and in fluid communication with one another.

In another illustrative control scheme, the controller 162 may monitor sensor signals to identify the positions of the pistons 130, 150. The controller 162 may be preprogrammed with an operating parameter such as piston cycle. The controller 162 may include instructions for estimating the time remaining for when the pistons 130, 150 reach the end of their stroke. If the remaining time is greater than the time needed to close the borehole valve 124, then the controller 162 may initiate a sampling activity by opening the sample valve 126 and closing the borehole valve 124. If the remaining time is not sufficient, then the controller 162 continues to monitor sensor signals until it determines that the time for completing the strokes of the pistons 130, 150 is sufficient to initiate sampling.

In still another embodiment, the controller 162 may control the pump 120 and/or the pump 140 to cause a desired time period for initiating a sampling event. For example, the controller 162 may transmit control signals that instruct one or both pumps 120, 140 to de-energize or otherwise return to a known operating state; e.g., the pistons 130, 150 move to a known position. Thereafter, the controller 162 may re-energize the pumps 120, 140 and initiate the sampling event by actuating the valves 124, 126.

Embodiments of the present disclosure may initiate a sampling activity without use of information relating to the pump 120, 140. For example, the pumps 120, 140 may be configured to operate at a known rate. The valves 124, 126 may be configured to open/close using this preprogrammed information.

Moreover, the control methodologies of the present disclosure may be utilized during any phase of the sampling event (e.g., from initiation of the sampling event to termination of the sampling event). Referring to FIG. 1, it should be noted that the vacuum applied by the perimeter pump 140 at region 101B may draw contaminated fluid away from the inlet to the sample line 106 of the sample pump 120. By drawing away contaminated fluids, there is a greater likelihood that the sample pump 120 draws "pristine" formation fluid from the region 101A. However, if operation of the perimeter pump 140 is interrupted while the sample pump 120 is operating, then contaminated fluid from region 101B may be drawn into the sample line 106 by the sample pump 120. During a sampling event, i.e., when valve 126 is open, this contaminated fluid may flow into the tank 110 and compromise the quality of the fluid sample. To ensure that primarily pristine fluid is received into the sample tank 110 during sampling, the valve 126 and/or pump 140 may be controlled to maintain a sufficient vacuum pressure in region 101B while valve 126 is open and permitting communication between line 122 and the sample tank 110. For example, the valve 126 may be actuated to the closed position before the perimeter pump 140 reaches the end of its stroke (or transient state 184). Alternatively or additionally, the operation of the perimeter pump 140 may be controlled such that the end of its stroke is reached only after the valve 126 is closed.

Figure 3:
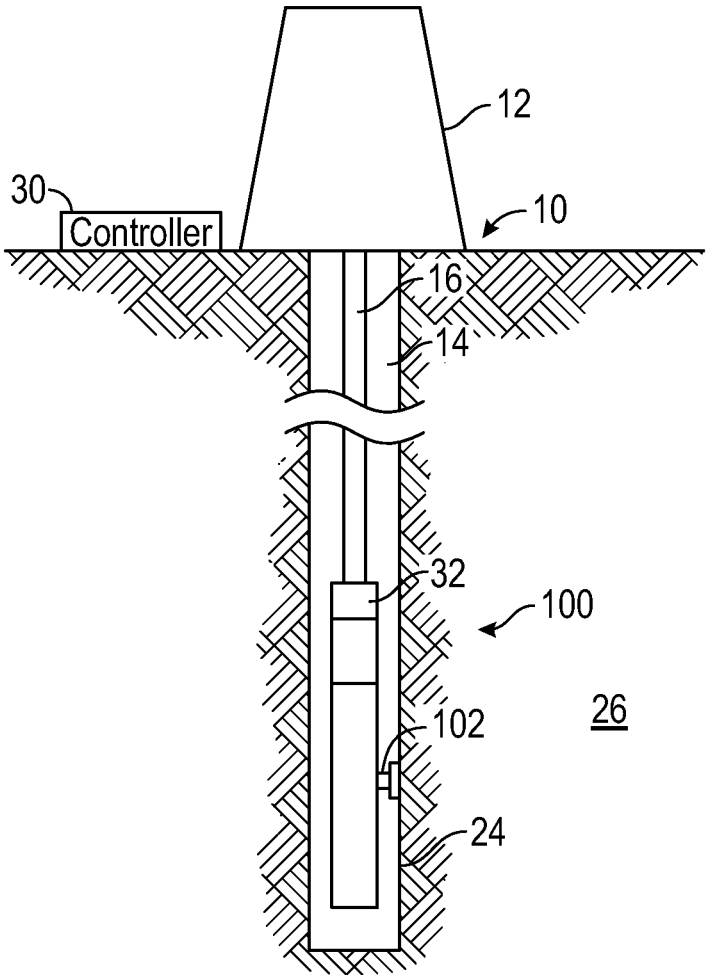
FIG. 3 shows a schematic of an apparatus for implementing one embodiment of the method according to the present disclosure.

As noted previously, embodiments of the present disclosure may be used in numerous situations. Merely to better describe the better disclosure, an embodiment suited for subsurface operations is shown in FIG. 3. FIG. 3 schematically illustrates a wellbore system 10 deployed from a rig 12 into a borehole 14. While a land-based rig 12 is shown, it should be understood that the present disclosure may be applicable to offshore rigs and subsea formations. The wellbore system 10 may include a carrier 16 and a fluid retrieval tool 100. As described previously, the tool 100 may include a probe 102 that contacts the borehole wall 24 for extracting formation fluid from a formation 26.

In some embodiments, the wellbore system 10 may be a drilling system configured to form the borehole 14. In such embodiments, the carrier 16 may be a coiled tube, casing, liners, drill pipe, etc. In other embodiments, the wellbore system 10 may convey the tool 100 with a non-rigid carrier. In such arrangements, the carrier 16 may be wirelines, wireline sondes, slickline sondes, e-lines, etc. The tool 100 may be controlled by a surface controller 30 and/or a downhole controller 32. The surface controller 30 and/or the downhole controller 32 may operate as the controller 162 (FIG. 1). Signals indicative of the parameter may be transmitted to a surface controller 30 via a suitable communication link. Illustrative communication links include, but are not limited to, data carrying conductors (e.g., wires, optical fibers, wired pipe), mud pulses, EM signals, RF signals, acoustical signals, etc.

Referring now to FIGS. 1 and 3, during one exemplary use, the fluid retrieval tool 100 is positioned adjacent a formation of interest and the probe 102 is pressed into sealing engagement with the borehole wall 24. The pumps 120, 140 may be operated to retrieve formation fluids. Often, fluid is pumped from the formation and ejected into the borehole via valves 124, 144 until it is determined that the retrieved fluid is sufficiently free of contaminants. Thereafter, it may be desired to direct the formation fluid into one or more sample tanks 110. Prior to initiating a sampling event, one or more operating parameters of the pumps 120, 140 may be monitored as discussed previously. For example, the positions of the pistons 130, 150 may be determined directly or indirectly. Upon determining that the pistons 130, 150 are positioned such that adequate time is available to complete a change in valve positions (e.g., open to close and close to open), the controller 162 may transmit appropriate control signals to cause the valve 124 to close and the valve 126 to open. The change in positions of the valves 124, 126 may occur in any order (e.g., valve 124 closes before valve 126 opens or valve 124 closes after valve 126 opens) or simultaneously.

In some embodiments, the controller 162 may include mechanical, electromechanical, and/or electrical circuitry configured to control one or more components of the tool 100. In other embodiments, the controller 162 may use algorithms and programming to receive information and control operation of the tool 100. Therefore, the controller 162 may include an information processor that is data communication with a data storage medium and a processor memory. The data storage medium may be any standard computer data storage device, such as a USB drive, memory stick, hard disk, removable RAM, EPROMs, EAROMs, flash memories and optical disks or other commonly used memory storage system known to one of ordinary skill in the art including Internet based storage. The data storage medium may store one or more programs that when executed causes information processor to execute the disclosed method(s). 'Information' may be data in any form and may be "raw" and/or "processed," e.g., direct measurements, indirect measurements, analog signal, digital signals, etc.

The term "carrier" as used in this disclosure means any device, device component, combination of devices, media and/or member that may be used to convey, house, support or otherwise facilitate the use of another device, device component, combination of devices, media and/or member. As used herein, the term "fluid" and "fluids" refers to one or more gasses, one or more liquids, and mixtures thereof.

While the foregoing disclosure is directed to the one mode embodiments of the disclosure, various modifications will be apparent to those skilled in the art. It is intended that all variations be embraced by the foregoing disclosure.

We claim:

1. A method of sampling fluid from a subsurface formation, comprising:

retrieving fluids from the formation using a plurality of pumps;

controlling a flow of the retrieved fluids using at least a first valve and a second valve;

estimating an operating parameter of at least one pump of the plurality of pumps;

wherein the operating parameter relates to one of: (i) a stroke of the piston, (ii) a position of the piston, and (iii) a time to complete a stroke of the piston;

controlling the first valve and the second valve using the estimated operating parameter to initiate a fluid sampling event;

communicating with a fluid container via the first valve;

communicating with a borehole via the second valve.

2. The method of claim 1, further comprising controlling the operating parameter of the at least one pump.

3. The method of claim 1, wherein the estimated operating parameter is associated with a predetermined pump rate for the at least one pump.

4. The method of claim 1 wherein controlling includes opening the first valve and closing the second valve.

5. The method of claim 1, wherein the plurality of pumps includes a sample pump and a perimeter pump, and further comprising: retrieving the fluid sample using the sample pump and forming a fluid isolation zone using the perimeter pump.

6. An apparatus for sampling fluid from a subsurface formation, comprising:

a plurality of pumps configured to retrieve fluids from the formation;

at least a first valve and a second valve configured to control a flow of the retrieved fluids;

a controller configured to control the first valve and the second valve using an estimated operating parameter of at least one pump of the plurality of pumps to initiate a fluid sampling event;

wherein the operating parameter relates to one of: (i) a stroke of the piston, (ii) a position of the piston, and (iii) a time to complete a stroke of the piston;

a fluid container in fluid communication with the first valve; and wherein the second valve is configured to control fluid communication with a borehole.

7. The apparatus of claim 6, wherein the controller is configured to control the operating parameter of the at least one pump.

8. The apparatus of claim 6, wherein the estimated operating parameter is associated with a predetermined pump rate for the at least one pump.

9. The apparatus of claim 6, wherein the controller is configured to open the first valve and close the second valve.

10. The apparatus of claim 6, wherein the plurality of pumps includes a sample pump and a perimeter pump, and wherein the sample pump is configured to retrieve the fluid sample and the perimeter pump is configured to form a fluid isolation zone.

* * * * *